US008439691B1

(12) United States Patent
Lan et al.

(10) Patent No.: US 8,439,691 B1
(45) Date of Patent: May 14, 2013

(54) ELECTRICAL CONNECTOR FOR REALIZING A HIGH SIGNAL TRANSMISSION RATE

(75) Inventors: Rong-Qin Lan, New Taipei (TW); Li-Jun Xu, New Taipei (TW); Ming-Han Lin, New Taipei (TW)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/332,683

(22) Filed: Dec. 21, 2011

(51) Int. Cl.
*H01R 12/00* (2006.01)

(52) U.S. Cl.
USPC ..... 439/79; 439/660

(58) Field of Classification Search ..... 439/79, 439/607.01, 607.11, 607.26, 607.34, 660, 439/676
See application file for complete search history.

(56) References Cited

U.S. PATENT DOCUMENTS 7,682,181 B1 * 3/2010 Jones et al. ..... 439/352
7,686,656 B2 * 3/2010 Zheng et al. ..... 439/660
7,806,735 B1 * 10/2010 Chen et al. ..... 439/676
7,857,665 B2 * 12/2010 Xiong et al. ..... 439/660
7,862,346 B1 * 1/2011 Wan et al. ..... 439/79
7,972,151 B2 * 7/2011 He et al. ..... 439/108
8,021,195 B2 * 9/2011 He et al. ..... 439/638
8,075,345 B2 * 12/2011 Peng ..... 439/660
8,133,078 B2 * 3/2012 Lin et al. ..... 439/660
8,147,276 B2 * 4/2012 Wang et al. ..... 439/660

* cited by examiner

*Primary Examiner* — Thanh Tam Le
(74) *Attorney, Agent, or Firm* — WPAT, P.C.; Anthony King

(57) ABSTRACT

An electrical connector includes an insulating body, a plurality of terminals disposed in top and bottom surfaces of the insulating body, a holding body mounted to a rear of the insulating body and defining a plurality of positioning apertures penetrating vertically therethrough, and an insulating housing having a base body and a tongue board extending forward from a front of the base body. Each terminal has a soldering tail stretching downward beyond a bottom of the rear of the holding body to be positioned in the positioning aperture. A bottom of the tongue board defines a receiving recess extending longitudinally to penetrate through the base body. A rear end of the receiving recess penetrates downward through the base body to define an opening. The insulating body with the terminals and the holding body is inserted forward in the receiving recess, and the holding body is secured in the opening.

7 Claims, 4 Drawing Sheets

ELECTRICAL CONNECTOR FOR REALIZING A HIGH SIGNAL TRANSMISSION RATE

BACKGROUND OF THE INVENTION

1. Field of the Invention

The present invention relates to an electrical connector, and more particularly to an electrical connector capable of realizing a high signal transmission rate.

2. The Related Art

Nowadays, with the development of electronic technology, electronic products and peripheral devices thereof are connected with each other more and more frequently. And it is a kind of common connection way to realize an electrical connection between the electronic product and its peripheral device by virtue of an electrical connector. Furthermore, the rapid developments of the electronic technology call for more stringent requirements to miniaturization and signal transmission rate of the electronic products. Conventionally, in order to have a high signal transmission rate, two or more traditional electrical connectors are pieced together. However, the pieced electrical connector often occupies a relatively large space so that cannot meet the requirement of miniaturization. Furthermore, the process of piecing together the traditional electrical connectors often needs to take a great quantity of manpower and material resources so that results in too high manufacture cost and lower productivity.

SUMMARY OF THE INVENTION

It is an object of the present invention to provide an electrical connector. The electrical connector includes an insulating body, a plurality of first terminals of which each has a first fastening strip, a first contact portion and a first soldering tail connected with two opposite ends of the first fastening strip, a plurality of second terminals of which each has a second fastening strip, a second contact portion and a second soldering tail connected with two opposite ends of the second fastening strip, a holding body mounted to a rear of the insulating body, and an insulating housing having a base body and a tongue board extending forward from an upper portion of a front of the base body. The first fastening strips are disposed in a top surface of the insulating body with the first contact portions projecting in front of the insulating body and the first soldering tails stretching downward behind the insulating body. The second fastening strips are disposed in a bottom surface of the insulating body with the second contact portions elastically projecting downward beyond the bottom surface of the insulating body and the second soldering tails penetrating downward through a rear part of the insulating body. The holding body defines a plurality of positioning apertures penetrating vertically therethrough for positioning the soldering tails therein. Free ends of the soldering tails further stretch beyond a bottom side of the holding body. A bottom of the tongue board defines a receiving recess extending longitudinally to penetrate through the base body. A front end of the bottom of the tongue board defines a plurality of positioning cavities connecting with the receiving recess. A rear end of the receiving recess penetrates downward through the base body to define an opening. The insulating body with the terminals and the holding body is inserted forward into the receiving recess of the insulating housing until a front end of the insulating body resists against a front inner side of the receiving recess. The first contact portions of the first terminals are positioned in the positioning cavities of the insulating housing respectively, and the holding body is secured in the opening.

As described above, the first terminals, the second terminals, the insulating body, the holding body and the insulating housing can be easily assembled together to form the electrical connector, so that economizes a great quantity of manpower and material resources, reduces manufacture cost of the electrical connector, and further increases productivity of the electrical connector. Moreover, the electrical connector of the present invention can meet the requirements of miniaturization and high signal transmission rate.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
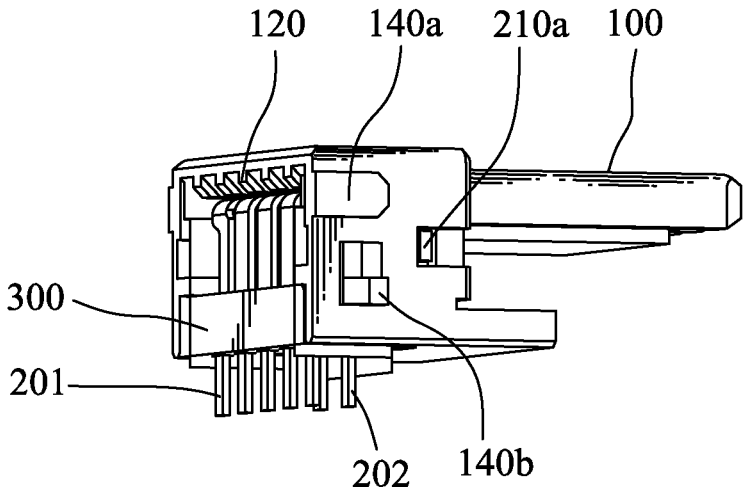
FIG. 1 is a perspective view of an electrical connector in accordance with an embodiment of the present invention.
Figure 3:
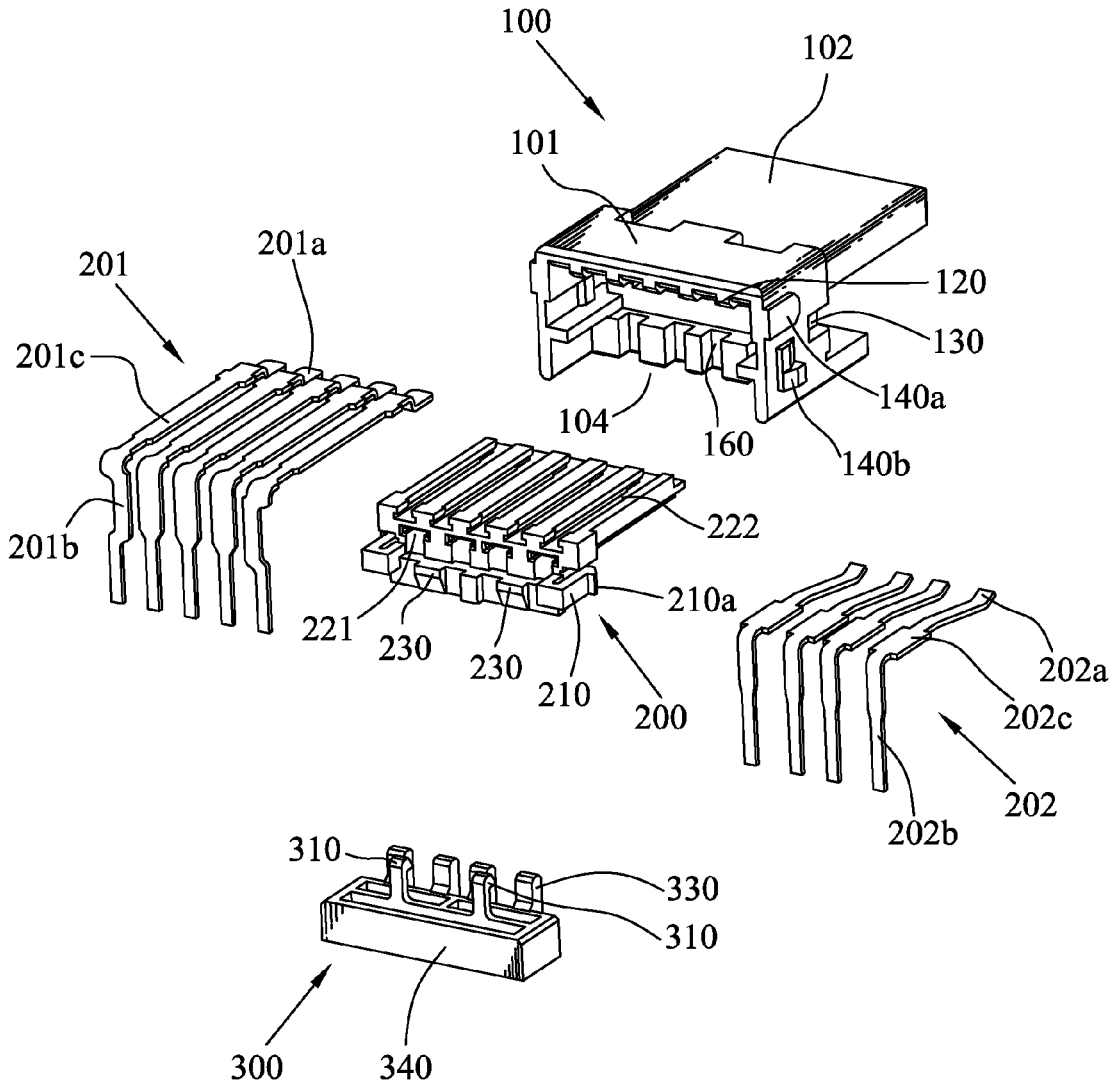
FIG. 3 and FIG. 4 are exploded views of the electrical connector of FIG. 1 viewed from two different angles.

Referring to FIG. 1 and FIG. 3, an electrical connector in accordance with an embodiment of the present invention includes an insulating housing 100, an insulating body 200 mounted to the insulating housing 100, a plurality of first terminals 201 disposed in the insulating body 200 and strengthened by the insulating housing 100, a plurality of second terminals 202 disposed in the insulating body 200, and a holding body 300 mounted to rears of the insulating housing 100 and the insulating body 200 for positioning and strengthening the first terminals 201 and the second terminals 202.

Figure 2:
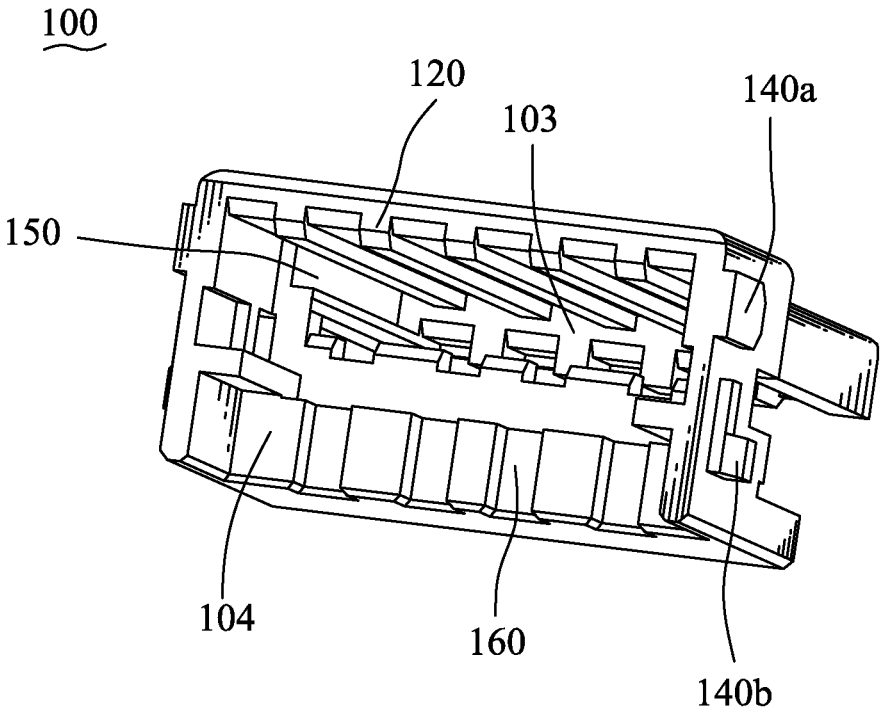
FIG. 2 is a perspective view of an insulating housing of the electrical connector of FIG. 1.
Figure 4:
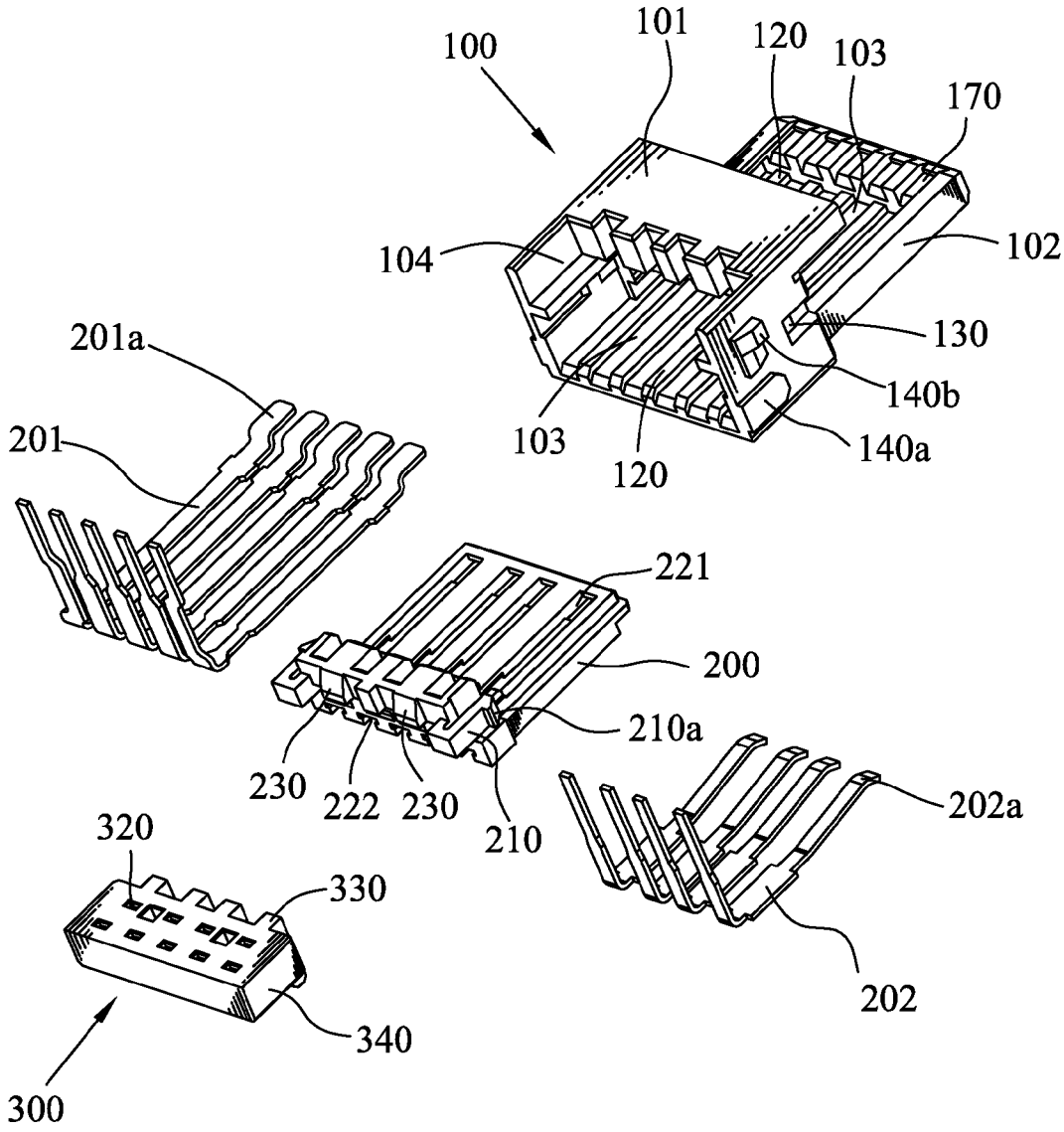

Referring to FIGS. 2-4, the insulating housing 100 has a rectangular base body 101 and a tongue board 102 extending forward from an upper portion of a front of the base body 101. A bottom of the tongue board 102 defines a rectangular receiving recess 103 extending longitudinally to penetrate through the base body 101. A front end of the bottom of the tongue board 102 defines a plurality of positioning cavities 170 arranged at regular intervals along a transverse direction of the tongue board 102 and communicating with the receiving recess 103. A rear of a bottom of the base body 101 defines a rectangular opening 104 opened under and connected with the receiving recess 103, with a plurality of positioning fillisters 160 opened in a front inner side of the opening 104 and each extending vertically to penetrate through the base body 101. A top inner side of the receiving recess 103 protrudes downward to form a plurality of positioning ribs 120 arranged at regular intervals along the transverse direction and each extending longitudinally in alignment with one corresponding positioning cavity 170. Two opposite inner sides of the receiving recess 103 are concaved oppositely outward to form a pair of guiding channels 150 each extending longitudinally to have an open rear end. Fronts of two opposite inner sides of the base body 101 define a pair of locking fillisters 130 connected with the receiving recess 103. Two opposite outer sides of the base body 101 protrude outward to form fastening blocks 140*a*, 140*b*.

Referring to FIG. 3 and FIG. 4, the insulating body 200 defines a plurality of receiving cavities 221 in a bottom surface thereof and a plurality of fastening cavities 222 in a top surface thereof, which are arranged at regular intervals along a transverse direction thereof and each extend longitudinally. A pair of locking barbs 210*a* oppositely protrudes outward at two free ends of a pair of elastic arms 210 formed by two opposite side edges of a rear of the insulating body 200 oppositely protruding outward and then extending forward. A bottom of the rear of the insulating body 200 protrudes rearward to form two holding blocks 230 spaced from each other.

Referring to FIGS. 1-4, each of the first terminals 201 has a first fastening strip 201*c*, a first contact portion 201*a* and a first soldering tail 201*b* which are connected with two opposite ends of the first fastening strip 201*c*. The first contact portion 201*a* is connected with the first fastening strip 201*c* in a step manner. The first soldering tail 201*b* is perpendicular to the first fastening strip 201*c*. The first fastening strips 201*c* are secured in the fastening cavities 222 of the insulating body 200, with the first contact portions 201*a* freely projecting in front of the insulating body 200, and the first soldering tails 201*b* stretching downward behind the insulating body 200.

Each of the second terminals 202 has a second fastening strip 202*c*, a second contact portion 202*a* and a second soldering tail 202*b* which are connected with two opposite ends of the second fastening strip 202*c*. The second soldering tail 202*b* is perpendicular to the second fastening strip 202*c*, and the second contact portion 202*a* is slanted beyond a plane of the second fastening strip 202*c* towards the same direction as the second soldering tail 202*b*. The second fastening strips 202*c* are secured in the receiving cavities 221 of the insulating body 200, with the second contact portions 202*a* projecting downward out of the receiving cavities 221, and the second soldering tails 202*b* penetrating downward through a rear part of the insulating body 200 and arranged in front of the first soldering tails 201*b*. When an external mating connector is connected with the electrical connector of the present invention, the second contact portions 202*a* are respectively pressed into the receiving cavities 221.

The holding body 300 has a rectangular positioning body 340 of which a middle protrudes upward to form a pair of fastening barbs 310 having free ends thereof curved forward to grapple the corresponding holding blocks 230 of the insulating body 200, so as to make the holding body 300 assembled to the insulating body 200 with a front of the positioning body 340 abutting against the bottom of the rear part of the insulating body 200. A front face of the positioning body 340 protrudes forward and then upward to form a plurality of strengthening ribs 330 of which tops are respectively inserted upward in the receiving cavities 221 to resist against rear ends of the corresponding second fastening strips 202*c* so as to strengthen the assembly of the second terminals 202 and the insulating body 200. The positioning body 340 defines two rows of positioning apertures 320 each penetrating vertically therethrough, wherein one row of positioning apertures 320 are arranged between the strengthening ribs 330 and the fastening barbs 310 for inserting the second soldering tails 202*b* therein, and the other row of positioning apertures 320 are arranged in a rear of the positioning body 340 for inserting the first soldering tails 201*b* therein. Free ends of the soldering tails 201*b*, 202*b* further project downward beyond a bottom side of the positioning body 340.

When the insulating body 200 with the terminals 201, 202 and the holding body 300 is assembled to the insulating housing 100, the insulating body 200 is inserted forward into the receiving recess 103 by means of cooperation, restriction and guidance between two opposite sides of the insulating body 200 and the guiding channels 150, until a front end of the insulating body 200 resists against a front inner side of the receiving recess 103. At this time, the locking barbs 210*a* are buckled in the locking fillisters 130 to ensure a firm assembly of the insulating body 200 and the insulating housing 100, the positioning body 340 of the holding body 300 is secured in the opening 104 by virtue of positioning lower portions of the strengthening ribs 330 in the corresponding positioning fillisters 160. The first contact portions 201*a* of the first terminals 201 are positioned in the positioning cavities 170 of the insulating housing 100 respectively. The positioning ribs 120 of the insulating housing 100 are inserted into the corresponding fastening cavities 222 of the insulating body 200 and abut against exposed top sides of the first fastening strips 201*c* to secure the first terminals 201 in the insulating body 200. The free ends of the soldering tails 201*b*, 202*b* of the terminals 201, 201 further stretch beyond the bottom of the base body 101 for being inserted into and soldered with a printed circuit board (not shown).

Figure 5:
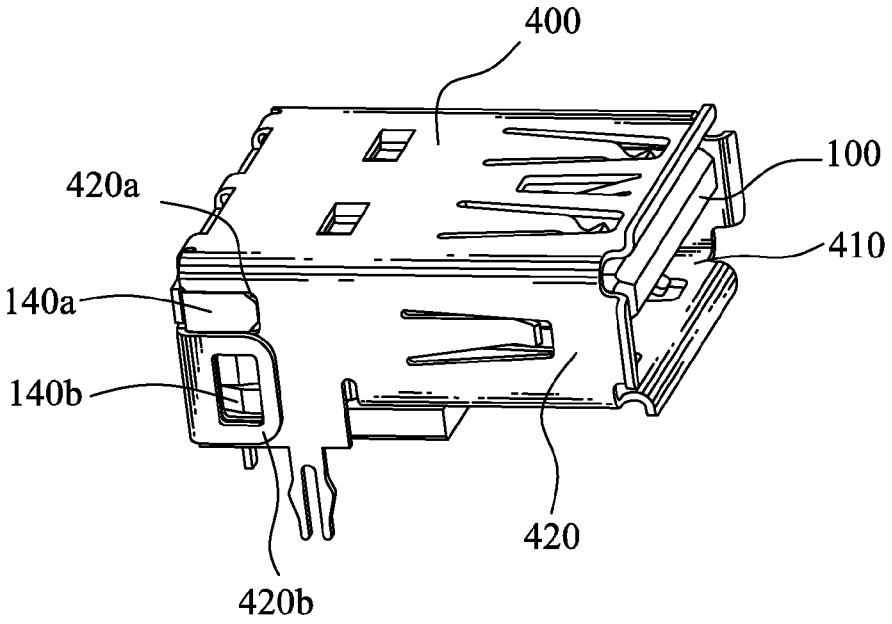
FIG. 5 is a perspective view of the electrical connector of FIG. 1 with a shielding shell.

Referring to FIG. 5, the electrical connector further includes a shielding shell 400 curved from a metal plate to show a rectangular cylinder shape and surrounding the insulating housing 100 so that not only can protect the insulating body 200, the holding body 300, the insulating housing 100 and the terminals 201, 202 from harm, but also can shield the terminals 201, 202 from static electricity. The tongue board 102 of the insulating housing 100 is apart from periphery insides of the shielding shell 400 to define an inserting space 410 therebetween having an open front end for inserting the external mating connector in the inserting space 410. The shielding shell 400 has a pair of side plates 420 of which each defines fastening structures 420*a*, 420*b* for buckling the corresponding fastening blocks 140*a*, 140*b* of the insulating housing 100.

As described above, the first terminals 201, the second terminals 202, the insulating body 200, the holding body 300, the insulating housing 100 and the shielding shell 400 can be easily assembled together to form the electrical connector, so that economizes a great quantity of manpower and material resources, reduces manufacture cost of the electrical connector, and further increases productivity of the electrical connector. Moreover, the electrical connector of the present invention can meet the requirements of miniaturization and high signal transmission rate.

What is claimed is:

1. An electrical connector, comprising:

an insulating body;

a plurality of first terminals each having a first fastening strip, a first contact portion and a first soldering tail connected with two opposite ends of the first fastening strip, the first fastening strips being disposed in a top surface of the insulating body with the first contact portions projecting in front of the insulating body and the first soldering tails stretching downward behind the insulating body;

a plurality of second terminals each having a second fastening strip, a second contact portion and a second soldering tail connected with two opposite ends of the second fastening strip, the second fastening strips being disposed in a bottom surface of the insulating body with the second contact portions elastically projecting downward beyond the bottom surface of the insulating body and the second soldering tails penetrating downward through a rear end of the insulating body;

a holding body mounted to the rear end of the insulating body and defining a plurality of positioning apertures penetrating vertically therethrough for positioning the first and second soldering tails therein, free ends of the soldering tails further stretching beyond a bottom side of the holding body; and an insulating housing having a base body and a tongue board extending forward from an upper portion of a front of the base body, a bottom of the tongue board defining a receiving recess extending longitudinally to penetrate through the base body, a front end of the bottom of the tongue board defining a plurality of positioning cavities connecting with the receiving recess, a rear end of the receiving recess penetrating downward through the base body to define an opening, wherein the insulating body with the first and second terminals and the holding body are inserted forward into the receiving recess of the insulating housing until a front end of the insulating body resists against a front inner side of the receiving recess, the first contact portions of the first terminals are positioned in the positioning cavities of the insulating housing respectively, and the holding body is secured in the opening, wherein a bottom of the rear of the insulating body protrudes rearward to form two holding blocks spaced from each other, the holding body has a positioning body of which a substantial middle protrudes upward to form a pair of fastening barbs having free ends thereof curved forward to grapple the corresponding holding blocks of the insulating body, so as to make the holding body assembled to the insulating body with a front of the positioning body abutting under the insulating body.

2. The electrical connector as claimed in claim 1, wherein a pair of locking barbs oppositely protrudes outward at two free ends of a pair of elastic arms formed by two opposite side edges of the rear of the insulating body oppositely protruding outward and then extending forward, fronts of two opposite inner sides of the base body define a pair of locking fillisters connected with the receiving recess for buckling the locking barbs therein.

3. The electrical connector as claimed in claim 2, wherein two opposite inner sides of the receiving recess are concaved oppositely outward to form a pair of guiding channels each extending longitudinally to have an open rear end, the insulating body is inserted forward into the receiving recess by means of cooperation, restriction and guidance between two opposite sides of the insulating body and the guiding channels.

4. The electrical connector as claimed in claim 3, wherein a top inner side of the receiving recess protrudes downward to form a plurality of positioning ribs each extending longitudinally in alignment with one corresponding positioning cavity to abut against exposed top side of the first fastening strip of the corresponding first terminal.

5. The electrical connector as claimed in claim 1, wherein a front face of the positioning body protrudes forward and then upward to form a plurality of strengthening ribs of which tops respectively resist upward under rear ends of the second fastening strips of the corresponding second terminals to strengthen the assembly of the second terminals and the insulating body.

6. The electrical connector as claimed in claim 5, wherein a plurality of positioning fillisters are opened in a front inner side of the opening of the insulating housing and each extends vertically to penetrate through the base body, the positioning body of the holding body is secured in the opening by virtue of positioning lower portions of the strengthening ribs in the corresponding positioning fillisters.

7. The electrical connector as claimed in claim 1, further comprising a shielding shell surrounding the insulating housing, the shielding shell having a pair of side plates each defining fastening structures, two opposite outer sides of the base body of the insulating housing protruding outward to form fastening blocks buckled with the corresponding fastening structures.

* * * * *